US005495645A

United States Patent [19]

Suzuki et al.

[11] Patent Number: 5,495,645

[45] Date of Patent: Mar. 5, 1996

[54] TYING METHOD AND MEMBER

[75] Inventors: Seiichi Suzuki; Yutaka Kamura, both of Tokyo, Japan

[73] Assignee: Max Co., Ltd., Tokyo, Japan

[21] Appl. No.: 116,763

[22] Filed: Sep. 7, 1993

[30] Foreign Application Priority Data

Sep. 7, 1992 [JP] Japan ..... 4-264263

[51] Int. Cl.[6] ..... B65D 77/00

[52] U.S. Cl. ..... 24/30.5 S; 24/30.5 R; 24/30.5 T

[58] Field of Search ..... 24/30.5 S, 30.5 R, 24/30.5 T, 545, 546, 908, 570, 571, DIG. 28

[56] References Cited

U.S. PATENT DOCUMENTS

| | | | |
|---|---|---|---|
| 779,614 | 1/1905 | Loe | 24/30.5 R |
| 3,130,509 | 4/1964 | Brooks | 24/30.5 R |
| 3,257,695 | 6/1966 | Frame | 24/571 |
| 3,604,066 | 9/1971 | Moon | 24/30.5 R |
| 3,882,573 | 5/1975 | Thomas, Jr. | 24/30.5 T |
| 3,925,852 | 12/1975 | Wood | 24/30.5 S |
| 4,267,995 | 5/1981 | McMillan | 248/74.1 |
| 4,292,714 | 10/1981 | Walker | 24/30.5 S |
| 4,663,807 | 5/1987 | Bozzo | 24/30.5 R |

FOREIGN PATENT DOCUMENTS

| | | | |
|---|---|---|---|
| 0428234 | 5/1991 | European Pat. Off. . | |
| 1353431 | 1/1964 | France | 24/30.5 S |
| 1808269 | 3/1960 | Germany . | |
| 1893877 | 5/1964 | Germany . | |
| 0580190 | 8/1958 | Italy | 24/30.5 R |
| 168590 | 7/1934 | Switzerland . | |
| 542762 | 11/1973 | Switzerland . | |

*Primary Examiner*—Victor N. Sakran
*Attorney, Agent, or Firm*—Cushman Darby & Cushman

[57] ABSTRACT

This is an object of the present invention to provide a tying method and member which has strong tying force and restrains itself from vertically shifting on a bag once the neck portion of the bag is tied up therewith. The tying method comprises the steps of fitting a tying member which is substantially a flat plate made of elastic material to an object to be tied up via a second opening, the tying member having a first opening for accommodating the object to be tied up, and mating member, the first opening being provided at one place within the flat plate, the second opening communicating with the first opening, the second opening extending up to the outer peripheral end of the flat plate; tightening the flat plate into substantially a conical shape with the first opening as the apex when the first opening is closed as its diameter is reduced by overlapping both side portions of the flat plate with the second opening as the boundary; and fixing the tying member thus tightened into the conical shape using the mating member. The tying member is a body substantially in the form of a flat plate made of elastic material and formed with the first opening having thorns, the second opening and a member for fixing the conical plate body, the first opening being closed as its diameter is reduced when the tying member is tightened into the conical shape with the first opening as the apex.

11 Claims, 6 Drawing Sheets

TYING METHOD AND MEMBER

BACKGROUND OF THE INVENTION

The present invention relates to a tying method and member for use in tying up the neck portion of a plastic bag (including a net bag) for containing processed foodstuffs, farm products or the like.

U.S. Pat. No. 3,021,354, for example, discloses a tying member for tying up neck portion of a plastic bag such as a bag of polyvinyl chloride. The tying member is provided with a slit for use in inserting the fastened neck portion of the bag into an opening for accommodating the neck portion, and thorns or projections extending from the peripheral edge of the opening to the center thereof.

Due to the fact that the outer end of the slit located on the outer peripheral edge of the tying member disclosed by the reference above is left open after the neck portion of the bag is tied up and closed, the neck portion of the bag may be forced out or otherwise the tying member itself may drop out of the neck portion thereof. Moreover, the shortcoming of the tying member is that the tying member may shift in the vertical direction of the bag thus tied up and consequently drop off the bag because the neck portion of the bag is only inserted through the slit into the opening of tying member.

On the other hand, Japanese Patent Laid-Open No. 4060/1987 discloses a tying member which is provided with an annular carrier, a plurality of elastic fingers projecting from the inner peripheral edge of the carrier toward the center thereof to form substantially a conical configuration, and an opening for receiving the neck portion of a bag in the center of the bag. This tying member features that the neck portion of the bag can readily be inserted. However, the tying member is still disadvantageous in that its tying force is weak even after the tying member is fitted to the neck portion of the bag through a slit between the elastic fingers and that, in view of its structure, the tying member tends to become costly.

SUMMARY OF THE INVENTION

An object of the present invention is to provide a tying method demonstrating a strong tying function using a tying member which is less costly. Another object of the present invention is to provide a tying method of making feasible the reutilization of such a tying member.

Still another object of the present invention is to provide a tying member which offers strong tying force while sticking to the neck portion where a bag is tied up without shifting in the vertical direction of the bag and restrains itself from particularly moving toward the end of the neck portion thereof once it is fitted thereto to ensure the intended tying function.

A tying method according to an embodiment of the present invention comprises the steps of fitting a tying member which is substantially a flat plate made of elastic material to an object to be tied up via a second opening, the tying member having a first opening for accommodating the object to be tied up, and a mating member, the first opening being provided at one place within the flat plate, the second opening communicating with the first opening, the second opening extending up to the outer peripheral end of the flat plate; tightening the flat plate into substantially a conical shape with the first opening as the apex when the first opening is closed as its diameter is reduced by overlapping both side portions of the flat plate with the second opening as the boundary; and fixing the tying member thus tightened into the conical shape using the mating member.

A tying member according to another embodiment of the present invention is substantially a body in the form of a flat plate made of elastic material and comprises a first opening for accommodating an object to be tied up, the first opening being provided at one place within the plate body; a second opening communicating with the first opening, the second opening extending up to the outer peripheral end of the flat plate, the first opening in the plate body being closed as its diameter is reduced when the tying member is tightened into a conical shape with the first opening as the apex, and a member for fixing the conical plate body.

A tying member as what is chosen by way of example may have a thorn projecting inwardly from at least one place on the peripheral edge of the first opening. Another tying member as what is chosen by way of example may have at least two mating member which mate with each other by making use of elasticity of the tying member, the mating member being provided on the respective sides of the outer end of the first opening. Still another tying member as what is chosen by way of example is such that the aforesaid fixing member may have a mating piece formed on one side of the plate body and a mating hole for use in inserting and fixing the mating piece with the second opening as the boundary, the mating hole being provided on the other side thereof. A further tying member as what is chosen by way of example is such that the aforesaid mating pieces extend along the peripheral edge of the plate body and that sawtooth-like portions may be formed on the respective opposed portions of each mating piece and the peripheral edge of the plate body.

A tying method according to still another embodiment of the present invention comprises the steps of fitting a tying member which is substantially a flat plate made of elastic material to an object to be tied up via a second opening, the tying member having a first opening for accommodating the object to be tied up, and a pair of mating pieces extending in substantially the same direction as the vertical axis of the second opening, the first opening being provided at one place within the flat plate, the second opening communicating with the first opening, the second opening extending up to the outer peripheral end of the flat plate; tightening the flat plate into substantially a conical shape with the first opening as the apex when the first opening is closed as its diameter is reduced by overlapping both side portions of the flat plate with the second opening as the boundary; and fixing the tying member thus tightened into the conical shape by twisting the mating pieces at least once.

Still another tying member as what is chosen by way of example is such that the fixing member may have mating pieces extending in substantially the same direction as the vertical axis of a second opening, first constricted portions being formed with the respective mating pieces and the opposed peripheral edge of the plate body, a pair of second notches being formed with the respective mating pieces and the opposed peripheral edge thereof.

A tying method according to still another embodiment of the present invention comprises the steps of fitting a tying member which is substantially a flat plate made of elastic synthetic resin which is subject to plastic deformation in a specific direction to an object to be tied up via a second opening, the tying member having a first opening for accommodating the object to be tied up, and at least two mating pieces on the respective sides of the outer end of the second opening, the first opening being provided at one place within the flat plate, the second opening communicating with the first opening, the second opening extending up to the outer peripheral end of the flat plate; tightening the flat plate into substantially a conical shape with the first opening as the apex when the first opening is closed as its diameter is reduced by overlapping both side portions of the flat plate with the second opening as the boundary; and fixing the tying member thus tightened into the conical shape by bending a portion of either mating piece in contact with the plate body.

A tying member according to still another embodiment of the present invention is substantially a flat plate made of elastic synthetic resin which is subject to plastic deformation in a specific direction and a body substantially in the form of a flat plate made of elastic material, and comprises a first opening for accommodating an object to be tied up, the first opening being provided at one place within the plate body, a second opening communicating with the first opening, the second opening extending up to the outer peripheral end of the flat plate, the first opening in the plate body being closed as its diameter is reduced when the tying member is tightened into a conical shape with the first opening as the apex, and at least two mating pieces on the respective sides of the outer end of the second opening and used to hold the conical shape of the tying member after being mated together by tucking and bending the mating pieces in contact with the plate body.

A tying method as what is chosen by way of example may include driving a fastener into the overlapped portion of the tying member as the aforesaid fixing step of fixing. Still another tying member as what is chosen by way of example is such that the fixing member may comprise a fastener as a body different from the plate body.

A tying method according to still another embodiment of the present invention comprises the steps of supplying substantially a flat plate made of elastic material; supplying a tying member prepared by punching a first opening for accommodating an object to be tied up and a second opening communicating with the first opening in the flat plate, the first opening being provided at one place within the plate body, the second opening extending up to the outer peripheral end of the flat plate; fitting the tying member to the object to be tied up via the second opening; tightening the flat plate into substantially a conical shape with the first opening as the apex when the first opening is closed as its diameter is reduced by overlapping both side portions of the flat plate with the second opening as the boundary; and fixing the tying member thus tightened into the conical shape after the tightening step is completed.

The tying method according to the present invention includes fitting the tying member in the form of a flat plate to an object to be tied up, overlapping both side portions of the flat plate with the second opening as the boundary so that the first opening is closed. Consequently, the object is tightly tied up and prevented from being forced out of the peripheral edge of the first opening. Moreover, the rigidity of the tying member increases since the whole tying member becomes cone-shaped with the first opening as the apex, thus increasing the resistance of the tying member to external force in this state.

Since the tying member according to the present invention is made of elastic material, the elasticity of the peripheral edge of the first opening which is closed as its diameter is reduced acts on an object to be tied up when the tying member in the form of a flat plate is fitted to the object and tightened into a conical shape with the first opening as the apex, so that the tying member may be adapted to the size of the diameter of the typing portion of the object. When the tied up condition is released, the tying member is restored to the flat plate and allowed to be used repeatedly.

Since thorns are formed on the peripheral edge of the first opening, the tying member demonstrates a strong tying function as they firmly stick to portion to be tied up.

The tying method according to the embodiment (claim 14) of the present invention results in cost reduction as the first and second openings are formed by punching in a flat plate.

DETAILED DESCRIPTION OF THE PREFERRED EMBODIMENTS

Referring to the accompanying drawings, the preferred embodiment of the present invention will subsequently be described in detail.

Figure 1:
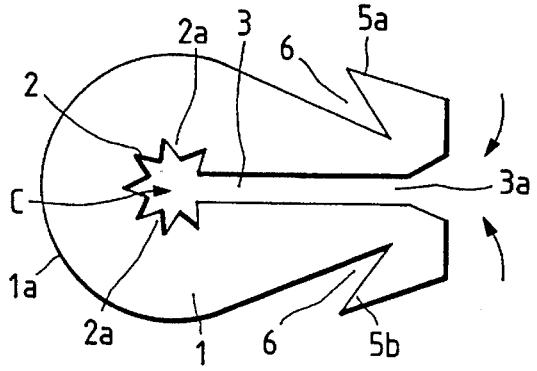
FIG. 1 shows a top view of a tying member before it is tightened according to the first embodiment of the present invention.
Figure 2:
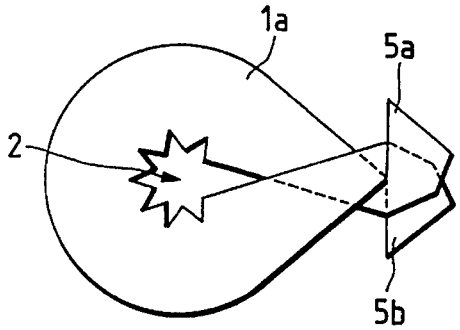
FIG. 2 shows a top view of the tying member after it is tightened according to the first embodiment of the present invention.

A tying member 1 of FIG. 1 is employed in a tying method according to the present invention for tying up the neck portion of a bag which is made of synthetic resin (e.g., polyvinyl chloride, polyethylene or polypropylene) and used for accommodating processed foodstuffs, farm products (e.g., potatoes and tangerines).

The tying member 1 is a flat plate made of synthetic resin (e.g., polypropylene, polyethylene, polyvinyl chloride, nylon or the like). The tying member 1 is elastic and substantially egg-shaped. A star-like opening (a first opening) 2 is formed substantially in the center of the tying member 1, the opening having a plurality of triangular thorns 2*a*, and part of the star-like opening 2 communicates with a slit (a second opening) 3 extending toward the leading end of the tying member 1. The slit 3 extends in the longitudinal direction of the egg-shaped tying member 1 and opens to the exterior of the tying member 1 at the outer end 3*a* thereof. The outer end 3*a* of the slit 3 is tapered in the direction opposite to the tying member 1 so as to help a user insert the neck portion 4*a* of a plastic bag 4 in the slit 3. On the respective sides of the outer end 3*a* of the slit 3 are mating pieces (member) 5*a*, 5*b*, each of which has an acute triangular shape extending in the direction of the tangent line of the plate body 1*a* of the tying member 1. In addition, a triangular mating notch 6 is formed between the egg-shaped peripheral portion 1*a* of the tying member 1 and each mating piece.

A description will subsequently be given of tying up the neck portion 4*a* of a bag 4 using the tying member 1. First, the tightened neck portion 4*a* of the bag 4 is inserted in the slit 3 and accommodated in the star-like opening 2. Then the mating pieces 5*b* and 5*a* are mated in such a manner that the former (lower one of FIG. 1) runs on the latter and the star-like opening 2 is completed shut. The mating notch 6 on the side of the mating piece 5*b* is mated with the mating notch 6 on the side of the mating piece 5*a*, that is, both the mating pieces 5*a*, 5*b* are overlapped with the mating piece 5*b* placed beneath the mating piece 5*a*. The mating piece 5*a* is fitted to the surface of the plate body of the tying member 1 close to the mating piece 5*b*.

Figure 3:
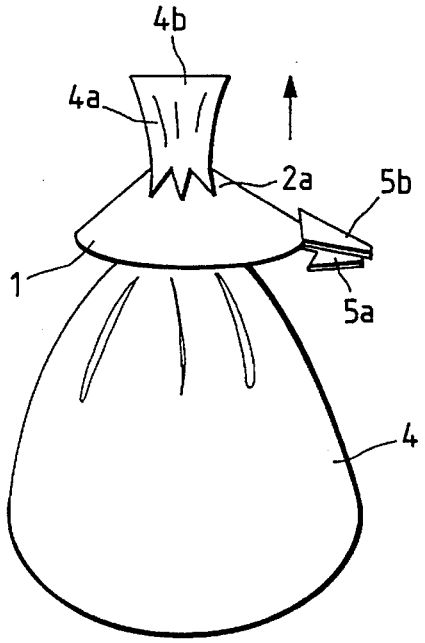
FIG. 3 shows a side view of the tying member used to tie up the neck portion of a bag.

FIG. 3 is a diagram illustrating the bag 4 with the neck portion 4*a* tied up by the tying member 1. The plate body 1*a* of the tying member 1 substantially becomes cone-shaped and the projections 2*a* on the peripheral edge of the star-like opening 2 bite into the neck portion 4*a* of the bag 4. The whole body of the tying member 1 is elastic and the elasticity of the projections 2*a* also works, so that the tying member 1 is hardly allowed to drop off the neck portion 4*a* of the bag 4. As the tying member 1 becomes cone-shaped with the star-like opening 2 as the apex after it is fitted to the bag, the elasticity of the projections 2*a* and the increased rigidity of the whole tying member raise the resistance of the tying member 1 to external force. The tying member 1 is prevented from slipping down toward the mouth 4*b* of the bag 4 because of the weight of the contents even when the bag 4 containing heavy material is turned upside down.

Figure 4:
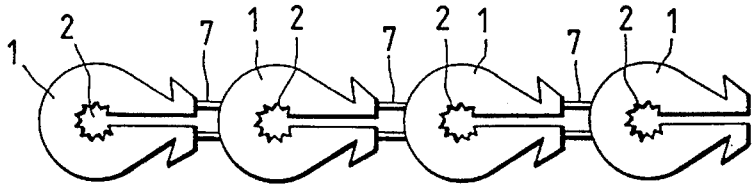
FIG. 4 shows a top view of a series of tying member coupled together according to the first embodiment of the present invention.

As shown in FIG. 4, many tying member 1 linked together can be formed by punching them in a plastic sheet. According to the embodiment shown in FIG. 4, the slits 3 of the respective tying member 1 are unidirectionally arranged in the axial linking direction and coupling portions 7 are used to link the respective tying member 1. The tying member 1 may otherwise be linked together in the direction perpendicular to the axial linking direction of the slits 3. Further, the tying member 1 may be supplied by cutting it in such a plastic sheet at the time it is used. In this way, the mechanization of tying work can be dealt with.

Figure 5:
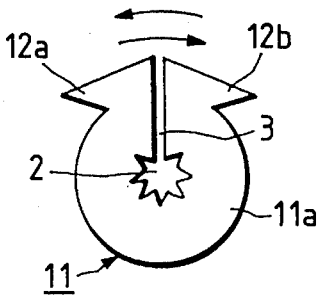
FIG. 5 shows a top view of a tying member before it is tightened according to the second embodiment of the present invention.

FIG. 5 illustrates a tying member 11 according to the second embodiment of the present invention. In comparison with the tying member 1, the tying member 11 is arranged so that the gap between each of the mating pieces 12*a*, 12*b* and the peripheral edge of the plate body 11*a* of the tying member 11 is set greater, the mating pieces 12*a*, 12*b* being projected substantially in both tangential directions of the plate body 11*a* of the tying member 11, respectively. Consequently, the mating pieces 12*a*, 12*b* can readily be tucked up.

Figure 6:
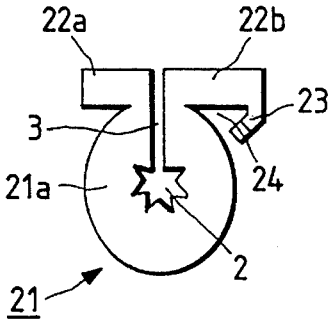
FIG. 6 shows a top view of a tying member before it is tightened according to the third embodiment of the present invention.

FIG. 6 illustrates a tying member 21 according to the third embodiment of the present invention. Mating pieces 22*a*, 22*b* are rectangular and projected in respective tangential directions of the plate body 21*a* of the tying member 21. A pawl 23 is also projected in the direction substantially perpendicular to the peripheral edge of the plate body 21*a* from the outer rear end of the mating piece 22*b*. When the neck portion 4*a* of the bag 4 is tied up, the mating piece 22*a* of the plate body 21*a* runs onto the mating piece 22*b* thereof with the slit 3 as the boundary and the mating piece 22*a* is inserted in the notch 24 between the mating piece 22*b* and the peripheral edge of the plate body 21*a* up to the back side of the mating piece 22*b*. The mating pieces 22*a*, 22*b* thus tucked up are hard to come apart because the end portion on the slit side of the mating piece 22*a* is caught by the pawl 23. When the pawl 23 is bent downward, the mating pieces 22*a*, 22*b* become harder to come apart. The mating member 21 is restored to its original state because of its elasticity and made reusable by releasing the locked condition of the mating pieces 22*a*, 22*b*.

Figure 7:
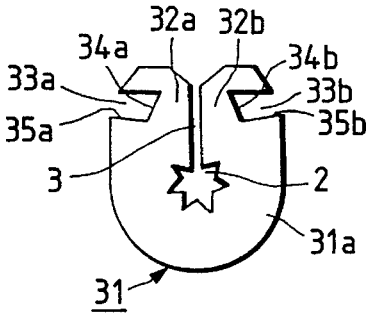
FIG. 7 shows a top view of a tying member before it is tightened according to the fourth embodiment of the present invention.

FIG. 7 illustrates a tying member 31 according to the fourth embodiment of the present invention. The plate body 31*a* of the tying member 31 is in an arcuate form which is slightly greater than a semicircle. Mating pieces 32*a*, 32*b* are formed round rectangular notches 33*a*, 33*b* made on the respective sides of the slit 3. When the mating pieces 32*a*, 32*b* are tucked up in such a way that the former runs onto the latter, an edge portion 35*b* on the plate body side of the notch 33*b* serves as a stopper for an edge portion 34*a* on the slit side of the mating piece 32*a*, so that the mating pieces 32*a*, 32*b* are hard to come apart. When the mating pieces 32*b*, 32*a* are tucked up in such a way that the former runs onto the latter, on the other hand, an edge portion 35*a* on the plate body side of the notch 33*a* serves as a stopper for an edge portion 34*b* on the slit side of the mating piece 32*b*, so that the mating pieces 32*a*, 32*b* are hard to come apart. The mating member 31 is restored to its original state because of its elasticity and made reusable by releasing the locked condition of the mating pieces 32*a*, 32*b*.

Figure 8:
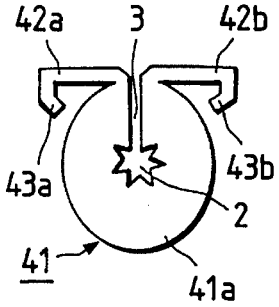
FIG. 8 shows a top view of a tying member before it is tightened according to the fifth embodiment of the present invention

FIG. 8 illustrates a tying member 41 according to the fifth embodiment of the present invention. The plate body 41*a* of the tying member 41 is substantially egg-shaped as in the case of the plate body 31*a* of the tying member 21 according to the third embodiment. Moreover, mating pieces 42*a*, 42*b* are substantially symmetrical or similar to the mating piece 22*b* of the tying member 21 and have respective pawls 43*a*, 43*b* extending in the direction perpendicular to the peripheral edge of the plate body 41*a*. When the mating pieces 42*a*, 42*b* are tucked up in such a way that either one runs onto the other, either the pawl 43*a* or 43*b* prevents the other mating piece 42*a* or 42*b* from coming apart therefrom. The mating member 41 is restored to its original state because of its elasticity and made reusable by releasing the locked condition of the mating pieces 42*a*, 42*b*.

Figure 9:
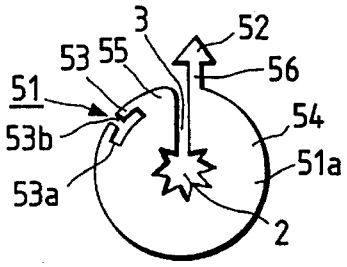
FIG. 9 shows a top view of a tying member before it is tightened according to the sixth embodiment of the present invention.

FIG. 9 illustrates a tying member 51 according to the sixth embodiment of the present invention. The plate body 51*a* of the tying member 51 is substantially circular and an arrowhead-like mating piece 52 is provided on one side (right-hand side of FIG. 9) at the outer end of the slit 3. A T-shaped notch 53 cut from the peripheral edge of the plate body 51*a* is provided on the other side of the outer end of the slit 3. The breadth of a lateral bar 53*a* in the head portion of the T-shape in the notch 53 is narrower than the maximum breadth of the mating piece 52. When the mating piece side 54 of the plate body 51*a* and a notch side 55 are tucked up and overlapped with the slit 3 therebetween after the neck portion 4*a* of the bag 4 is tied up by the tying member 51, a slender coupling portion 56 of the mating piece 52 is inserted in a vertical bar 53*b* of the notch 53 and the mating piece 52 is mated with the peripheral edge of the vertical bar 53 of the mating piece 52.

When the mating piece side 54 of the plate body 51*a* and the notch side 55 are overlapped, either one may be placed on top of the other. Therefore, the mating piece 52 is mated with the peripheral edge of the vertical bar 53*b* on the inner or outer side face of a conical shape when the tying member 51 becomes cone-shaped after tying the neck portion 4*a* of the bag 4. The mating member 51 is restored to its original state because of its elasticity and made reusable by releasing the mating piece 52 from the notch 53.

Figure 10:
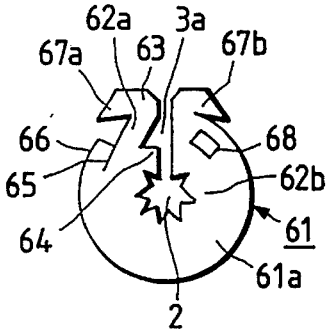
FIG. 10 shows a top view of a tying member before it is tightened according to the seventh embodiment of the present invention.

FIG. 10 illustrates a tying member 61 according to the seventh embodiment of the present invention. A notch at an acute angle is made in an edge portion on a pawl side 62*a* of the plate body 61*a* of the tying member 61 halfway across a slit 3*a* extending from the star-like opening 2 to the leading end of the tying member 61, whereby a triangular first pawl 64 is formed. Moreover, a linear notch 64 is made to form a second pawl 66 on the outer edge of the pawl side 62*a* of the plate body 61*a* at substantially the same position as that of the first pawl 64 with the slit 3*a* as a coordinate axis.

On the pawl side 62*a* and a mating hole side 62*b* are mating pieces 67*a*, 67*b* having substantially the same configuration and extending right and left on the respective sides of the outer end of the slit 3*a*. A rectangular mating hole 68 is formed in the neighborhood of the mating piece 67*b* on the mating hole side 62*b* of the plate body 61*a*.

When the neck portion 4*a* of the bag 4 is tied up, the mating hole side 62*b* and the pawl side 62*a* of the plate body 61*a* are tucked up and the mating pieces 67*b*, 67*a* are overlapped in such a way that the former runs onto the latter. Moreover, the first pawl 64 is inserted in the mating hole 68 when the tying member 61 becomes substantially cone-shaped, and the side edge portion on the mating hole side 62*b* of the slit 3 and a second pawl 66 (a gap is formed with the pawl side 62*a* that has become cone-shaped) are overlapped. Consequently, the state in which the pawl side 62*a* and the mating hole side 62*b* of the tying member 61 have been tucked up is firmly held. The mating member 61 is restored to its original state because of its elasticity and made reusable by releasing the locked condition of the mating pieces 67*a*, 67*b*.

Figure 11:
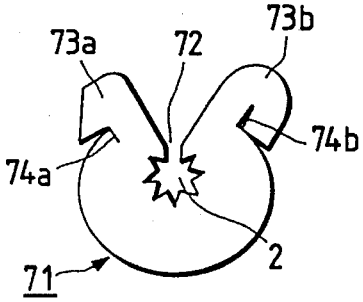
FIG. 11 shows a top view of a tying member before it is tightened according to the eighth embodiment of the present invention.

FIG. 11 illustrates a tying member 71 according to the eighth embodiment of the present invention. The tying member 71 has a tapered opening (a second opening) 72 extending from the star-like opening 2 to the leading end of the tying member 71 instead of the slit according to the embodiments as stated above. The tapered opening 72 functions as what ties up the neck portion 4*a* only by inserting the neck portion 4*a* of the bag 4 in it. Mating pieces 73*a*, 73*b* on the respective sides of the tapered opening 72 are formed with liner notches 74*a*, 74*b* provided substantially in respective parallel edges of the tapered opening 72.

When the neck portion 4*a* of the bag 4 is tied up, the mating pieces 73*b*, 73*a* are tucked up in such a way that the former runs onto the latter and the notches 74*a*, 74*b* are engaged. After the tying member 71 becomes cone-shaped to tie up the neck portion 4*a* of the bag 4, the tying member 71 maintains that shape. The mating member 71 is restored to its original state because of its elasticity and made reusable by releasing the locked condition of the mating pieces 73*a*, 73*b*.

Figure 12:
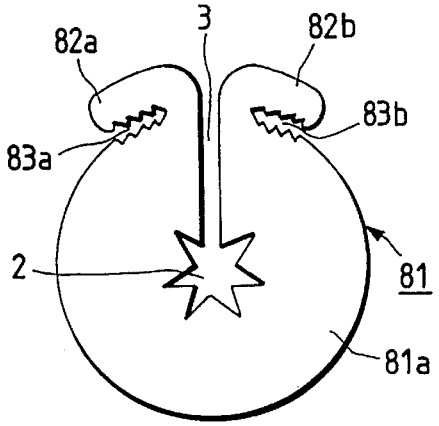
FIG. 12 shows a top view of a tying member before it is tightened according to the ninth embodiment of the present invention.

FIG. 12 illustrates a tying member 81 according to the ninth embodiment of the present invention. The plate body 81*a* of the tying member 81 is substantially circular and the slit 3 extends from the star-like opening 2 to the leading end of the tying member 81. Symmetrical mating pieces 82*a*, 82*b* extend along the peripheral edge of the plate body 81*a* on the respective sides of the outer end of the slit 3. Corrugated (like a Christmas tree) notches 83*a*, 83*b* which open at the outer edges of the respective mating pieces 82*a*, 82*b* are formed between the respective mating pieces 82*a*, 82*b* and the peripheral edge of the plate body 81*a*. Therefore, sawtooth-like corrugations are formed on the edge portions of the plate body 81*a* opposite to the mating pieces 82*a*, 82*b*.

Figure 13:
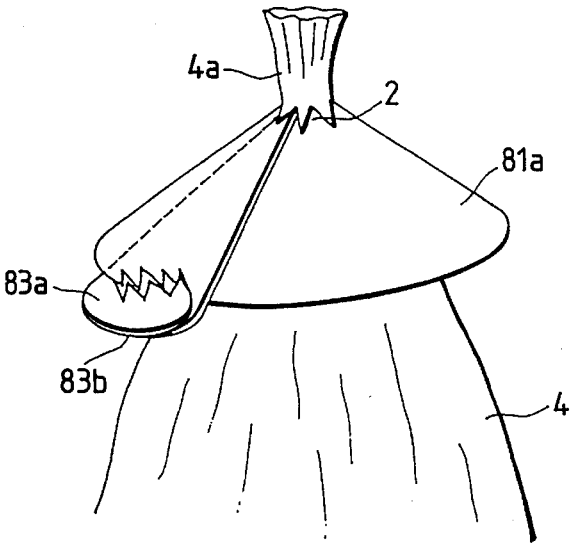
FIG. 13 shows a perspective view of the tying member in such a state that the neck portion of the bag has been tied up according to the ninth embodiment of the present invention.

When the neck portion 4*a* of the bag 4 is tied up, the mating pieces 82*a*, 82*b* are tucked up in such a way that either one runs onto the other as shown in FIG. 13 and the plate body 81*a* becomes cone-shaped, whereas the corrugated notches 83*a*, 83*b* are engaged. As the sawtooth-like corrugations on the inner edges of the notches 83*a*, 83*b* engage with each other, the notches 83*a*, 83*b* are hard to come apart. The mating member 81 is restored to its original state because of its elasticity and made reusable by releasing the locked condition of the mating pieces 82*a*, 82*b*.

Figure 14:
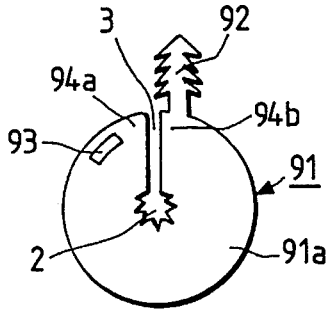
FIG. 14 shows a top view of a tying member before it is tightened according to the tenth embodiment of the present invention.

FIG. 14 illustrates a tying member 91 according to the tenth embodiment of the present invention. The tying member 91 is similar to what is shown in FIG. 9 according to the sixth embodiment and the plate body 91*a* thereof is substantially circular and the slit 3 extends from the star-like opening 2 to the leading end of the tying member 81. A mating piece like a Christmas tree in shape projects in the same direction as that of the slit 3 on the right-hand side of the outer end of the slit 3 as shown in FIG. 14, whereas an arcuate mating hole 93 extending in the circumferential direction of the plate body 91*a* is formed on the left-hand side of the outer end thereof. The length of the mating hole 93 is set shorter than the breadth of the mating piece 92. When the neck portion 4*a* of the bag 4 is tied up, a mating piece side 94*b* and a mating hole side 94*a* of the plate body 91*a* are overlapped in such a way that either one runs onto the other with the slit 3 as the boundary and then the mating piece 92 is inserted in the mating hole 92 and mated with the peripheral edge thereof. The mating member 91 is restored to its original state because of its elasticity and made reusable by releasing the mating piece 92 from the mating hole 93.

Figure 15:
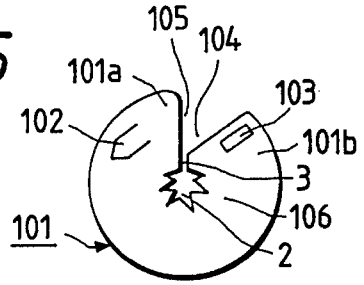
FIG. 15 shows a top view of a tying member before it is tightened according to the eleventh embodiment of the present invention.

FIG. 15 illustrates a tying member 101 according to the eleventh embodiment of the present invention. The tying member 191 as a whole is substantially circular and has no mating pieces such as those fitted to the tying member according to the first to fifth and the sixth to ninth embodiments. In addition, the slit 3 communicating with the star-like opening 2 is very short. As shown in FIG. 15, a cut-raised mating piece 102 is provided on a mating piece side 101*a* on the left-hand side of the slit 3, whereas a rectangular mating hole 103 is provided on a mating piece side 101*b* on the right-hand side thereof. A continuous portion reaching the outer peripheral edge of the tying member from the edge on the mating hole side of the slit 3 forms an open edge portion tilting with respect to the slit 3. The mating hole 103 extends along the open tilted edge portion 104. The edge portion on the mating piece side of the slit 3 directly extends up to the outer peripheral edge of the tying member 104. A tapered opening (a second opening) 105 is formed at the leading end of the slit 3.

When the neck portion 4*a* of the bag 4 is tied up, the neck portion 4*a* thereof is accommodated in the star-like opening 2 while it is tightened. Then the mating hole side 101*b* of a plate body 106 and the mating piece side 101*a* thereof are overlapped in such a way that the former runs onto the latter and the mating piece 102 is inserted in the mating hole 103. While the mating piece 101 is tightened, it remains cone-shaped. The mating member 101 is restored to its original state because of its elasticity and made reusable by pulling the mating piece 102 out of the mating hole 103.

Figure 16:
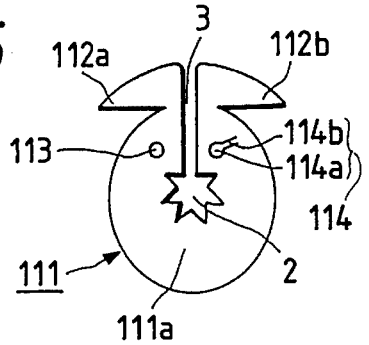
FIG. 16 shows a top view of a tying member before it is tightened according to the twelfth embodiment of the present invention.

FIG. 16 illustrates a tying member 111 according to the twelfth embodiment of the present invention. The overall configuration of the tying member 112 is substantially similar to that of the tying member 11 according to the second embodiment shown in FIG. 5 and the tying member 111 is provided with mating pieces 112*a*, 112*b* projecting along the transverse axis of the slit 3 on the respective sides of the outer end thereof. As shown in FIG. 16, a circular mating hole 113 is formed on the mating piece side 112*a* of a plate body 111*a* on the left-hand side of the slit 3, whereas a cut-raised mating piece 114 is formed on the mating piece side 112*b* of the plate body 111*a* on the right-hand side thereof. The mating piece 114 comprises a circular mating portion 114*a* to be inserted in and mated with the mating hole 113, and a slender rectangular coupling portion 114*b* for coupling the circular mating portion 114*a* to the plate body 111*a*. The diameter of the circuit mating portion 114*a* is set slightly smaller than that of the mating hole 113.

When the neck portion 4*a* of the bag 4 is tied up, the tying member 111 is tucked up with the slit 3 as the boundary in such a way that the mating piece 112*a* of the plate body 111*a* runs onto the mating piece 112*b* thereof and the circular mating portion 114*a* of the mating piece 114 is inserted in and mated with the mating hole 113 by member of a tying machine (not shown), for example. After the mating piece 114 is pulled out of the mating hole 113 so as to take the contents out of the bag 4, the neck portion 4*a* of the bag 4 is tied up again by manually joining the mating pieces 112*a*, 112*b* together. The mating member 111 is restored to its original state because of its elasticity and made reusable by releasing the locked condition of the mating pieces 112*a*, 112*b*.

Figure 17:
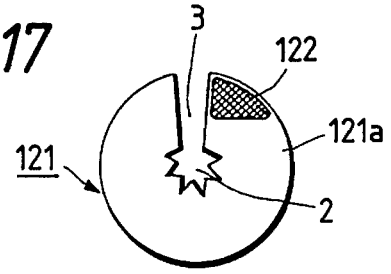
FIG. 17 shows a top view of a tying member before it is tightened according to the thirteenth embodiment of the present invention.

FIG. 17 illustrates a tying member 121 according to the thirteenth embodiment of the present invention. The tying member 121 as a whole is substantially circular and the slit 3 extends from the star-like opening 2 the outer peripheral edge of the tying member 121. An adhesive-coated portion 122 is provided on one side (right-hand side of FIG. 17) of a plate body 121*a* with the slit 3 as the boundary. The adhesive-coated portion 122 may be what is heat-sealable by making use of the properties of the plastic tying member 21 or otherwise formed with an adhesive tape. The tying member 121 fitted to the neck portion 4*a* of the bag 4 becomes cone-shaped by overlapping one side of the plate body 121*a* and the other side thereof with the slit 3 as the boundary.

FIGS. 18 to 23 illustrate tying member according the fourteenth to eighteenth embodiments of the present invention. With these embodiments, the form of each tying member after it has been tightened is steadily held by twisting its mating pieces.

Figure 18:
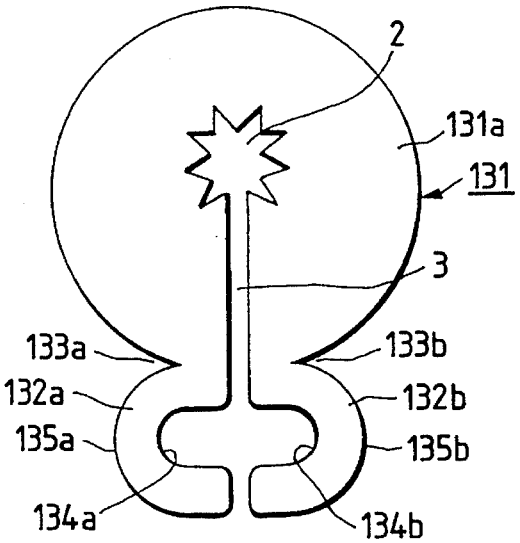
FIG. 18 shows a top view of a tying member before it is tightened according to the fourteenth embodiment of the present invention.

FIG. 18 illustrates a tying member 131 according to the fourteenth embodiment of the present invention. The plate body 131*a* of the tying member 131 is substantially circular and the slit 3 extends from the star-like opening 2 to the leading end of the tying member 131. U-shaped mating pieces 132*a*, 132*b* having the same configuration are provided on the respective sides of the outer end of the slit 3. The U-shaped inner edge portions (second notches) 134*a*, 134*b* of the respective mating pieces 132*a*, 132*b* are set face to face and they form substantially an elliptical contour on the whole, whereby substantially triangular notches (first notches) 133*a*, 133*b* are formed between the mating pieces 132*a*, 132*b* and the outer peripheral edge of the plate body 131*a*, respectively.

Figure 19:
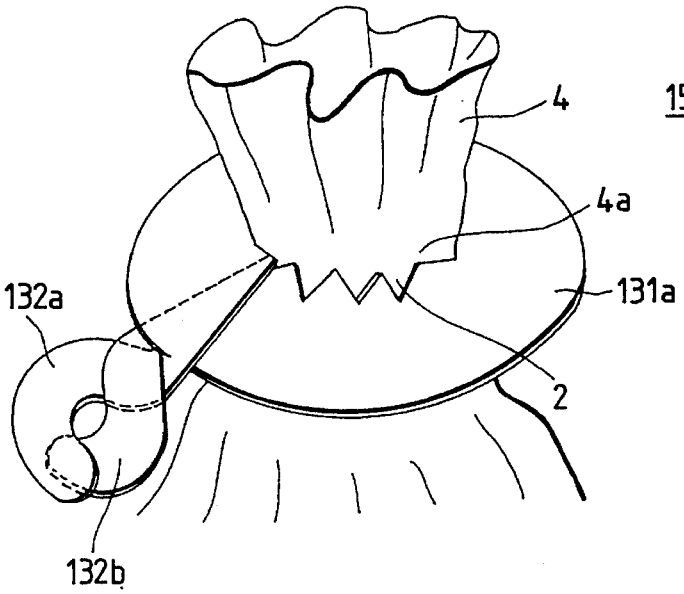
FIG. 19 shows a perspective view of the tying member in such a state that the neck portion of the bag has been tied up according to the fourteenth embodiment of the present invention.

When the neck portion 4*a* of the bag 4 is tied up, the peripheral edge of the notch 133*a* and that of the notch 133*b* are engaged as either the mating piece side 132*a* of the plate body 131*a* or the mating piece side 132*b* runs on the other. Consequently, the mating pieces 132*a*, 132*b* are set opposite to each other in such a form that the U-shaped outer peripheral edges face each other. As shown in FIG. 19, the mating pieces 132*a*, 132*b* are tucked up again in such a way that either one runs onto the other, whereby the mating pieces 132*a*, 132*b* are twisted once to firmly hold the resulting state. The mating member 131 is restored to its original state because of its elasticity and made reusable by releasing the locked condition of the mating pieces 132*a*, 132*b*.

Figure 20:
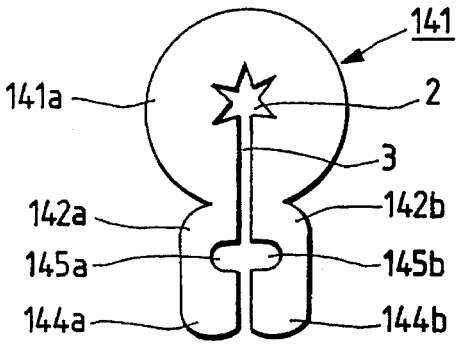
FIG. 20 shows a top view of a tying member before it is tightened according to the fifteenth embodiment of the present invention.

FIG. 20 illustrates a tying member 141 according to the fifteenth embodiment of the present invention. Unlike the tying member 13 according to the fourteenth embodiment, the tying member 141 has mating pieces 142*a*, 142*b* which are different in configuration from the mating pieces 132*a*, 132*b*. In other words, the mating pieces 142*a*, 142*b* are symmetrical about the vertical axis of the slit 3 and substantially rectangular on the whole. Handles 144*a*, 144*b* located at the respective leading ends of the mating pieces 142*a*, 142*b* extend forward by certain length (greater than the width of the thumb of a grown-up person) from the front edges of U-shaped notches (second notches), respectively. Like the mating pieces 132*a*, 132*b*, the mating pieces 142*a*, 142*b* are also mated with each other by twisting once. As the handles 144*a*, 144*b* are long enough for any person to pick up them with his thumb and forefinger, the mating pieces 142*a*, 142*b* can easily be twisted and untwisted. The mating member 141 is restored to its original state because of its elasticity and made reusable by releasing the locked condition of the mating pieces 142*a*, 142*b*.

Figure 21:
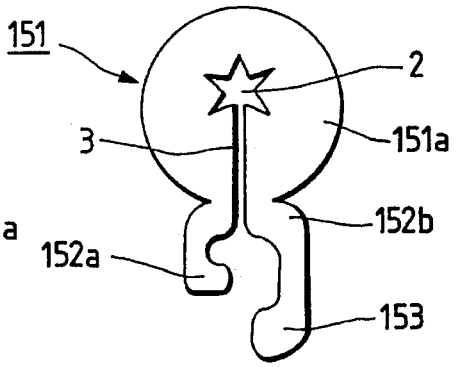
FIG. 21 shows a top view of a tying member before it is tightened according to the sixteenth embodiment of the present invention.

FIG. 21 illustrates a tying member 151 according to the sixteenth embodiment of the present invention. The slit 3 extends from the star-like opening 2 of the plate body 151*a* of the tying member 151 up to the leading end of the plate body 151*a*. As shown in FIG. 21, a mating piece 152*a* is provided on the left-hand side of the outer end of the slit 3, whereas a mating piece 152*b* is provided on the right-hand side of the outer end thereof. The whole mating piece 152*b* is longitudinally lone and D-shaped and has a handle 153 equivalent to a lower lateral bar of D which is longer than the width of the thumb of a grown-up person at its leading end. As shown in FIG. 21, the length of the mating piece 152*a* is approximately ½ of that of the mating piece 152*b*.

When the neck portion 4*a* of the bag 4 is tied up, the mating pieces 142*a*, 142*b* are also mated with each other by twisting once as in the case of the tying member 131. Since the handle 153 of the mating piece 152*b* on one side bulges out from the leading end of the mating piece 152*a* then, the mating piece 152*b* can easily be twisted with respect to the mating piece 152*a* and also untwisted by picking it with the thumb and the forefinger after the neck portion 4*a* of the bag 4 has been tied up. The mating member 151 is restored to its original state because of its elasticity and made reusable by releasing the locked condition of the mating pieces 152*a*, 152*b*.

Figure 22:
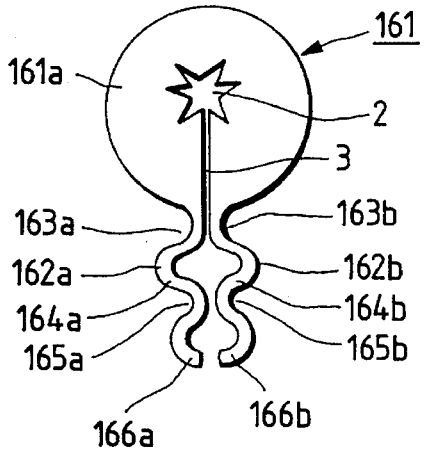
FIG. 22 shows a top view of a tying member before it is tightened according to the seventeenth embodiment of the present invention.

FIG. 22 illustrates a tying member 161 according to the seventeenth embodiment of the present invention. The slit 3 extends from the star-like opening 2 of the plate body 161*a* of the tying member 161 up to the leading end of the plate body 161*a*. Wavy mating pieces 162*a*, 162*b* which are symmetrical about the slit 3 extend forward on the respective sides of the outer end of the slit 3, the wave of each mating piece having two crests. The mating pieces 162*a*, 162*b* have first constricted portions (first notches) 163*a*, 163*b*, second constricted portions (second notches) 164*a*, 164*b*, third constricted portions 165*a*, 165*b* and fourth constricted portions 166*a*, 166*b*, these constricted portions being arranged in order from one side close to the plate body 161*a*. When the neck portion 4*a* of the bag 4 is tied up, the mating pieces 162*a*, 162*b* are twisted twice because these constricted portions are tucked up. Consequently, the mating pieces 162*a*, 162*b* firmly hold the tied up state. The mating member 161 is restored to its original state because of its elasticity and made reusable by releasing the locked condition of the mating pieces 162*a*, 162*b*.

Figure 23:
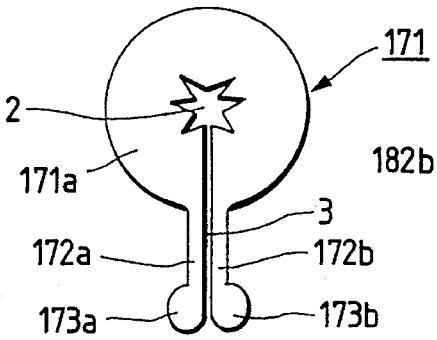
FIG. 23 shows a top view of a tying member before it is tightened according to the eighteenth embodiment of the present invention.

FIG. 23 illustrates a tying member 171 according to the eighteenth embodiment of the present invention. The slit 3 extends from the star-like opening 2 of the plate body 171*a* of the tying member 171 up to the leading end of the plate body 171*a*. The tying member 171 is different from those according to the aforementioned embodiments and made of commercial synthetic resins which are subject to plastic deformation in a specific direction and have elasticity in other directions. Such plastic deformative synthetic resins used for the tying member 171 have a fiber axis in the axial direction of the slit 3 and demonstrate plasticity in the transverse direction with respect to the fiber axis. The slit 3 is directly extended up to the leading ends of the mating pieces 172*a*, 172*b*. Moreover, substantially semicircular knobs 173*a*, 173*b* are formed at the respective leading ends of the slender mating pieces 172*a*, 172*b*.

When the neck portion 4*a* of the bag 4 is tied up, the mating pieces 172*a*, 172*b* of the plate body 171*a* are tucked up in such a way that either one runs onto the other. The plate body 171*a* becomes cone-shaped and is fitted to the neck portion 4*a* of the bag 4. Then the mating pieces 172*a*, 172*b* are locked repeatedly and plastic deformation helps to firmly hold this condition. The mating member 171 is restored to its original state because of its elasticity and made reusable by releasing the locked condition of the mating pieces 172*a*, 172*b*.

Figure 24:
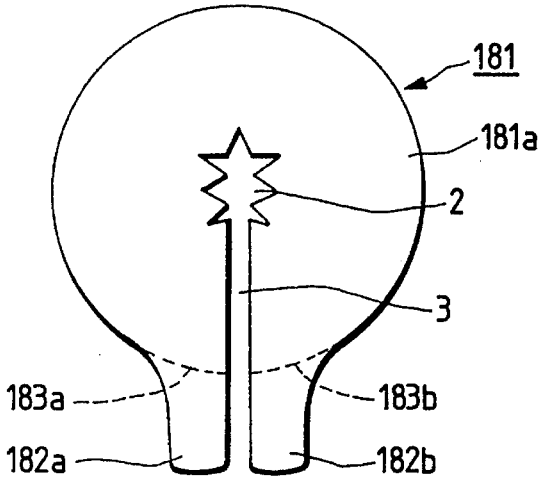
FIG. 24 shows a top view of a tying member before it is tightened according to the nineteenth embodiment of the present invention.

FIG. 24 illustrates a tying member 181 according to the nineteenth embodiment of the present invention. The tying member 181 is made of the aforementioned plastic deformative synthetic resin. The tying member 181 has slender rectangular mating pieces 182*a*, 182*b* on the respective sides of the slit 3 extending from the star-like opening 2. Fiber of plastic deformative synthetic resin extends in the axial direction of the slit 3.

Figure 25:
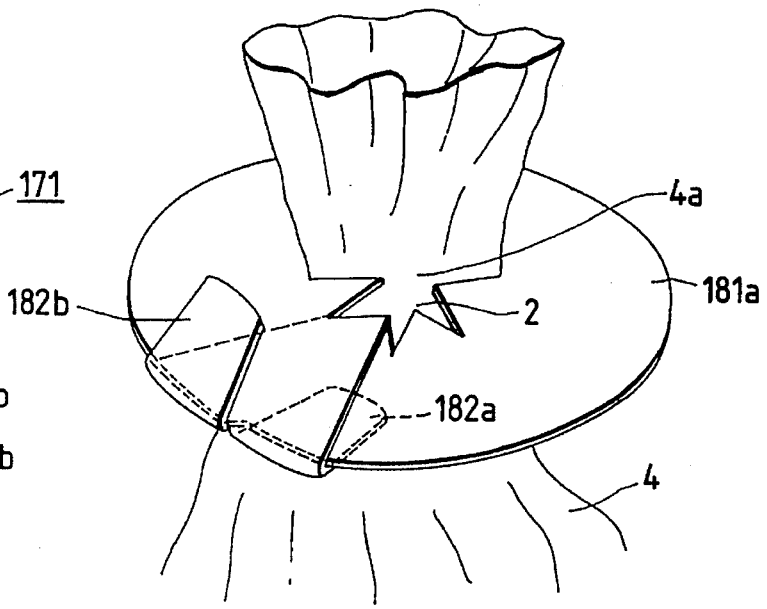
FIG. 25 shows a perspective view of the tying member in such a state that the neck portion of the bag has been tied up according to the nineteenth embodiment of the present invention.

As shown in FIG. 25, the tying member 181 is fitted to the neck portion 4*a* of the bag 4 when the neck portion 4*a* of the bag 4 is tied up and the mating pieces 182*a*, 182*b* of the plate body 181*a* are tucked up in such a way that either one runs onto the other. Then the mating pieces 182*a*, 182*b* are bent in the vertical direction of the plate body 181*a* along respective folds 183*a*, 183*b* and mated with the plate body 181*a* and also mated with each other. The mating member 181 is restored to its original state because of its elasticity and made reusable by releasing the locked condition of the mating pieces 182*a*, 182*b*.

Figure 26:
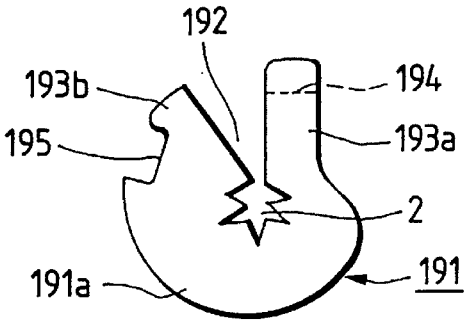
FIG. 26 shows a top view of a tying member before it is tightened according to the twentieth embodiment of the present invention.

FIG. 26 illustrates a tying member 191 according to the twentieth embodiment of the present invention. The tying member 191 is also made of the aforementioned plastic deformative synthetic resin. The plate body 191*a* of the tying member 191 is substantially semicircular and the star-like opening 2 communicates with a tapered opening (a second opening) 192 and opens on the outer peripheral edge of the tying member 191. As shown in FIG. 26, a rectangular mating piece 193*a* is provided on the right-hand side of the tapered opening 192 and bent along the fold 194 at the leading end at the time of tying up the mating piece, whereas a rectangular notch 195 is formed at a place where the outer edge of a mating piece 193*b* communicates with the outer peripheral edge of the plate body 191*a* on the left-hand side of the tapered opening 192.

When the neck portion 4*a* of the bag 4 is tied up, the mating pieces 193*a*, 193*b* of the plate body 191*a* are tucked up in such a way that the former runs onto the latter. After the plate body 191*a* becomes cone-shaped, the leading end of the mating piece 193*a* is bent along the fold 194 down the plate body 191*a*. The leading end of the mating piece 193*a* mates with both edges of the notch 195 and the lower edge thereof to ensure that it remains to stick to the plate body 191*a*. Since the tying member 191 is restored to its original state by extending the leading end of the mating piece 193*a*, it is usable repeatedly.

Figure 27:
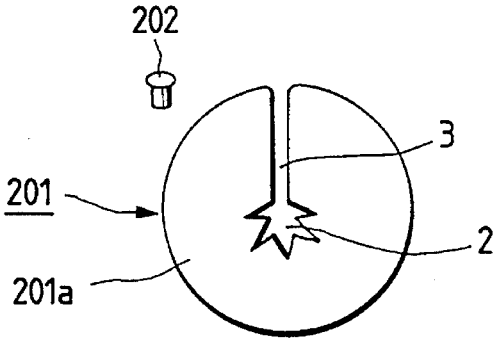
FIG. 27 shows a top view of a tying member before it is tightened according to the 21st embodiment of the present invention.
Figure 28:
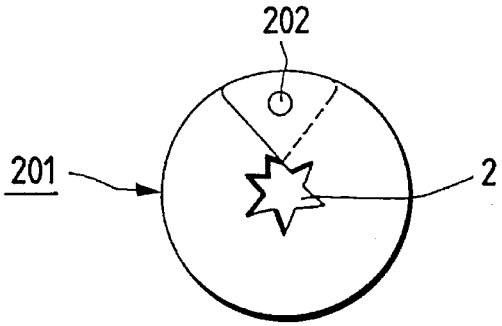
FIG. 28 shows a top view of the tying member after it is tightened according to the 21st embodiment of the present invention.

FIGS. 27 and 28 illustrate a tying member 201 according to the 21st embodiment of the present invention. The tying member 201 comprises a plastic plate body 201*a* and a rivet 202. The plate body 201*a* is substantially circular and the slit 3 extends from the star-like opening 2 located at the center of the circular shape up to the peripheral edge of the plate body 201*a*.

When the neck portion 4*a* of the bag 4 is tied up, either side of the plate body 201*a* is made to overlap the other with the slit 3 as the boundary to have the plate body 201*a* cone-shaped and the rivet 202 is hammered by a tying machine into a portion where both sides of the plate body are overlapped (see FIG. 28). In the case of this embodiment, the extent to which the both sides of the plate body are overlapped may freely be chosen. In order to reuse the tying member 201, mating pieces extending in the tangential or diametrical direction of the plate body 201*a* may be provided on the respective sides of the outer end of the slit 3.

Figure 29:
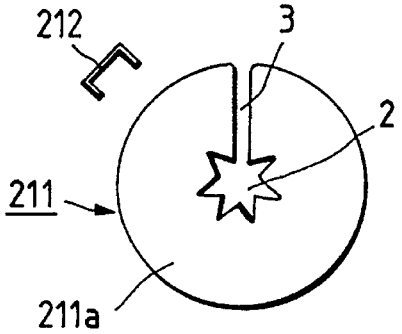
FIG. 29 shows a top view of a tying member before it is tightened according to the 22nd embodiment of the present invention.
Figure 30:
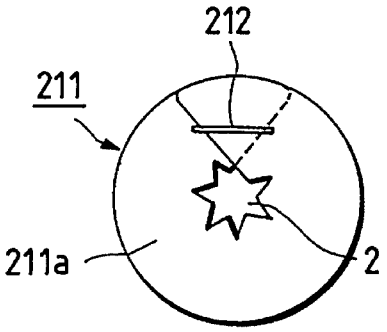
FIG. 30 shows a top view of the tying member after it is tightened according to the 22nd embodiment of the present invention.

FIGS. 29 and 30 illustrate a tying member 211 according to the 22nd embodiment of the present invention. A plate body 211*a* is similar in shape to the plate body 201*a*. In this case, a ⊃-shaped staple in stead of the rivet 202 is employed (see FIG. 30).

The tying member 201, 211 with reference to FIG. 21 and according to the 22nd embodiment of the present invention are excellent for general purpose use because the extent to which the both sides of the plate body with the slit 3 as the boundary are overlapped may freely be chosen to a certain degree in conformity with the dimensions of the bag 4.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

What is claimed is:

1. A tying member comprising:

a flat flexible material portion having an edge, said material portion having a first opening formed therethrough which is spaced away from said edge, and a second opening defining a slot which communicates with said first opening and extends to said edge, said slot defining opposing first and second side regions on either side of said slot, a part of said first side region being engageable in overlapping manner with a part of said second side region;

wherein said first and second side regions comprise first and second mating members, respectively, which engage with each other by making use of the flexibility of said material portion, said mating members being provided on the respective sides of said slot adjacent to said edge of said material portion, wherein, when said part of said first side region is engaged with said part of said second side region, said material portion adopts a conical shape with said first opening disposed at an apex of the cone and a constrictive tying force is imparted at said first opening.

2. A tying member according to claim 1, further comprising:

a thorn projecting from a peripheral edge of said first opening.

3. A tying member according to claim 1, wherein said engageable part of said first side region comprises an insertable engaging part, and wherein said part of said second side region engaged by said engageable part comprises a mating hole for engagingly receiving said insertable engaging part to thereby hold said material portion in a flexed and generally conical shape.

4. A tying member according to claim 1, wherein said engageable part of said first side region and said part of said second side region engaged by said engageable part each include a sawtooth projection at a peripheral portion thereof, said sawtooth portion of said first side region being adapted to engage with said sawtooth portion of said second side region to thereby maintain said material portion in a flexed and generally conical shape.

5. A tying member according to claim 1, wherein said part of said first side region is adhesively engaged with said part of said second side region.

6. A tying member according to claim 1, wherein said first and second side regions each have first constricted portions adjacent a peripheral portion thereof and a pair of second constricted portions being formed with the respective mating pieces and the opposed peripheral edge thereof.

7. A tying member according to claim 1, wherein said part of said first side region comprises a fastener which is spaced away from the material portion.

8. A tying method using a tying device made from a flat portion of a flexible material, the flat portion having a first opening formed therein and a second opening defining a slot in communication with the first opening and an edge of the flat portion, the slot defining first and second radially extending side regions of the flexible material on either side of the slot, comprising the steps of:

fitting an object to be tied through the first opening;

establishing a constrictive tying force on the object to be tied by reducing a diameter of the first opening by drawing the first side region toward the second side region in overlapping manner to thereby form a cone with the first opening at the apex thereof; and intertwining the first side region and the second side region so as to maintain the conical shape of the flexible material and the constrictive tying force on the object to be tied.

9. A tying method according to claim 8, wherein said fixing step comprises driving a fastener into an overlapped portion of the material portion.

10. A tying member which is substantially a flat plate made of elastic synthetic resin which is subject to plastic deformation in a specific direction, the tying member comprising:

a body substantially in the form of a flat plate made of elastic material, the plate body having;

a first opening for accommodating an object to be tied up, the first opening being provided at one place within the plate body, a second opening communicating with the first opening, the second opening extending up to the outer peripheral end of the flat plate, the first opening in the plate body being closed as its diameter is reduced when the tying means is tightened into a conical shape with the first opening as the apex, and at least two mating pieces provided on the respective sides of the outer end of the second opening and used to hold the conical shape of the tying means after being mated together by tucking and bending the mating pieces in contact with the plate body.

11. A tying method comprising the steps of:

fitting tying means which is substantially a flat plate made of elastic material to an object to be tied up via a second opening, the tying means having said second opening, a first opening for accommodating the object to be tied up, and mating means, the first opening being provided at one place within the flat plate, the second opening communicating with the first opening, the second opening extending up to the outer peripheral end of the flat plate;

tightening the flat plate into substantially a conical shape with the first opening as the apex when the first opening is closed as its diameter is reduced by overlapping both side portions of the flat plate with the second opening as the boundary; and fixing the tying means thus tightened into the conical shape using the mating means, wherein said elastic material is an elastic synthetic resin which is subject to plastic deformation in a specific direction, in which said mating means is at least two mating pieces provided on the respective sides of the outer end of the second opening, and the tying means is fixed by bending a portion of either mating piece in contact with the plate body.

* * * * *